US007744159B2

(12) United States Patent
Lee

(10) Patent No.: US 7,744,159 B2
(45) Date of Patent: Jun. 29, 2010

(54) HEIGHT ADJUSTMENT MECHANISM FOR ARMREST

(75) Inventor: Ching-Yang Lee, Chu-Pei (TW)

(73) Assignee: Isotech Products Incorporated, Hsin Chu (TW)

( * ) Notice: Subject to any disclaimer, the term of this patent is extended or adjusted under 35 U.S.C. 154(b) by 348 days.

(21) Appl. No.: 12/068,760

(22) Filed: Feb. 11, 2008

(65) Prior Publication Data

US 2010/0038950 A1 Feb. 18, 2010

(51) Int. Cl.
*A47C 7/54* (2006.01)

(52) U.S. Cl. ..... 297/411.36

(58) Field of Classification Search ..... 297/353, 297/411.36

See application file for complete search history.

(56) References Cited

U.S. PATENT DOCUMENTS 5,388,892 A * 2/1995 Tornero ..... 297/411.36
5,620,233 A * 4/1997 Corwin ..... 297/411.36
6,053,579 A * 4/2000 Nelson et al. ..... 297/411.36
6,336,680 B1 * 1/2002 Lee ..... 297/411.36
6,419,323 B1 * 7/2002 Chu et al. ..... 297/411.36
6,974,189 B2 * 12/2005 Machael et al. ..... 297/411.36
6,974,190 B1 * 12/2005 Hung ..... 297/411.36
2007/0164595 A1 * 7/2007 Chi ..... 297/411.36
2008/0191537 A1 * 8/2008 Oda ..... 297/411.36
2008/0296955 A1 * 12/2008 Geister et al. ..... 297/411.36

* cited by examiner

*Primary Examiner*—Peter R. Brown
(74) *Attorney, Agent, or Firm*—Muncy, Geissler, Olds & Lowe, PLLC

(57) ABSTRACT

An armrest adjustment mechanism is disclosed. The armrest adjustment mechanism includes a sleeve, a tubular member, a slider, a long plate, a fixing plate, a guiding plate, a retaining block, a lower base, an armrest pad and a lever arm. The armrest adjustment mechanism features on that: an insertion hole is disposed on upper end of the long plate while the lever arm is arranged inside a space between the armrest pad and the lower base. The lever arm inserts through the insertion hole on top end of the long plate so that the long plate hangs on the lever arm, working as a load. One end of the lever arm is arranged on one side of the lower base, working as the fulcrum while the other end of the lever arm is arranged on an opposite side of the lower base correspondingly. A push member projecting from a corresponding opening of the lower base is arranged on the other end of the lever arm, working as the effort. Thus the push member is moved upwards by being pushed by the user from the outside or elastically turned back to the original position so as to make the lever arm (like a Type-2 lever) drives the long plate to move upwards synchronously. Therefore, the adjustment of the armrest height is achieved.

4 Claims, 10 Drawing Sheets

HEIGHT ADJUSTMENT MECHANISM FOR ARMREST

BACKGROUND OF THE INVENTION

The present invention relates to a height adjustment mechanism, especially to a height adjustment mechanism for an armrest that have a lever arm disposed between an armrest pad and a lower base and working like a Type-2 (Class two) lever for adjusting height of the armrest by pushing one end of the lever arm.

There are various designs of the armrest height adjustment mechanism. The inventor of the present invention has invented an armrest height adjustment device and obtained U.S. Pat. No. 6,336,680 HEIGHT-ADJUSTMENT MECHANISM FOR ARMREST, as shown in FIG. 10 & FIG. 11. The height adjustment mechanism for an armrest includes a sleeve 10, a tubular member 20, a slider 30, a long plate 40, a fixing plate 50, a guiding plate 60 and a retaining block 70. While adjusting height of the armrest, by pulling up a handle 41 manually, the long plate 40 is moved upwards elastically (the spring 43 is extended simultaneously) so that a projection 45 moves upwards and leans against a projection of the guiding plate 60 and a lower end of the guiding plate 60 moves outwards and leaves original position. Thus the retaining block 70 is released from a locating hole 22, as shown in FIG. 9 and now the slider 30 moves freely inside a sliding slot 21 for adjusting the height. After the armrest being adjusted to a new height, the handle 41 is released so that the long plate 40 turns back to the original position by elasticity of the spring 43 and the projection 45 moves downwards to leave the projection 61 of the guiding plate 60. Thus the retaining block 70 automatically turns back by elasticity of the guiding plate 60 and locks into a new locating hole 22 to finish the height adjustment. However, the pulling-up of the handle 41 mentioned above requires more effort and is inconvenient for the user. Moreover, the handle 41 on a top end of the long plate 40 projecting outwards has negative effects on appearance of the lower base of the armrest.

SUMMARY OF THE INVENTION

Therefore it is a primary object of the present invention to provide an armrest adjustment mechanism. The armrest adjustment mechanism includes a sleeve, a tubular member, a slider, a long plate, a fixing plate, a guiding plate, a retaining block, a lower base, an armrest pad and a lever arm. The armrest adjustment mechanism features on that: an insertion hole is disposed on upper end of the long plate while the lever arm is arranged between the armrest pad and the lower base. The lever arm inserts through the insertion hole on top end of the long plate so that the long plate hangs on the lever arm, working as the load. One end of the lever arm is arranged on one side of the lower base, working as the fulcrum while the other end of the lever arm is arranged on an opposite side of the lower base correspondingly. A push member projecting from a corresponding opening of the lower base is arranged on the other end of the lever arm, working as the effort. Thus the push member is moved upwards by being pushed by the user from the outside or elastically turned back to the original position so as to work like a Type-2 lever. By pushing the push member to move upwards, the lever arm is driven to make the long plate move upwards synchronously. Therefore, the adjustment of the armrest height is achieved by manual operation of the long plate. Moreover, the height adjustment mechanism of the armrest is simplified and convenience of use is enhanced.

DETAILED DESCRIPTION OF THE PREFERRED EMBODIMENT

Figure 1:
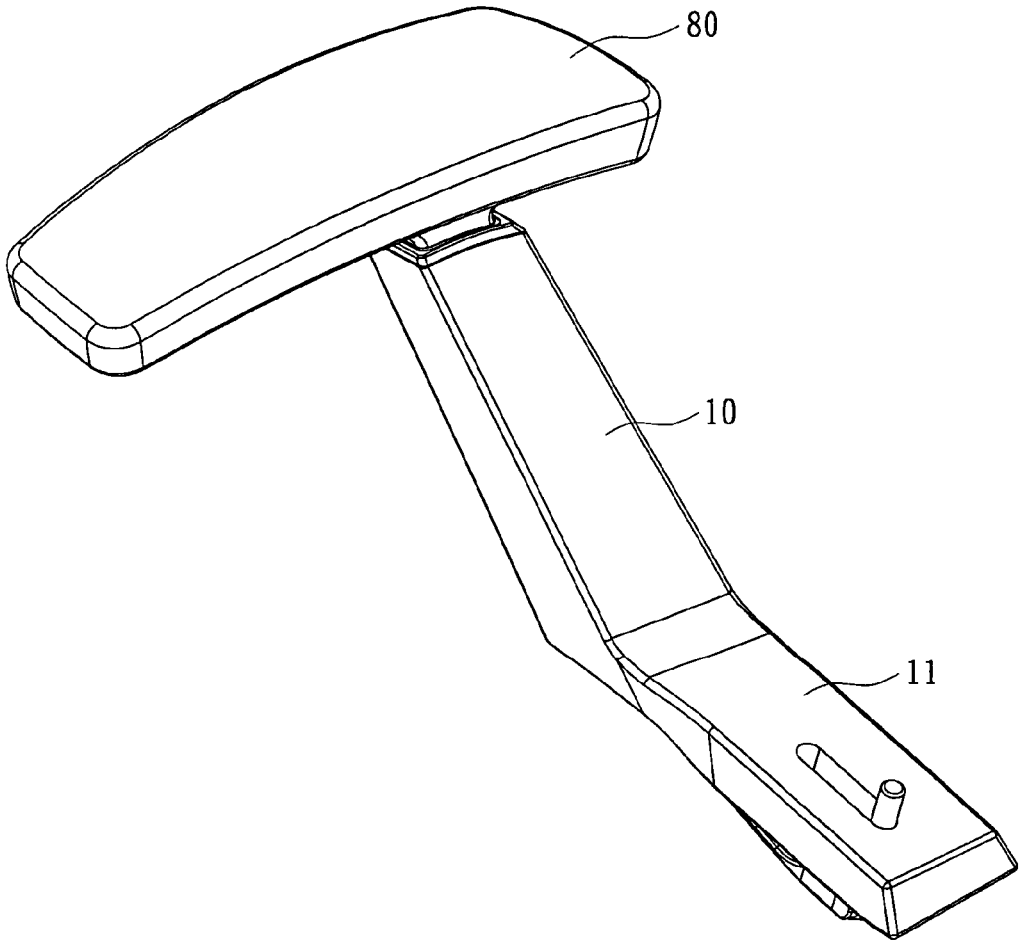
FIG. 1 is a perspective view of an embodiment according to the present invention.

The present invention is based on the prior art (U.S. Pat. No. 6,336,680) mentioned above-mentioned. The present invention includes a sleeve 10, a tubular member 20, a slider 30, a long plate 40, a fixing plate 50, a guiding plate 60, and a retaining block 70. The function and assembling of the present invention are similar to those of the prior art while there are changes in appearance, angles, length and ratio.

Figure 2:
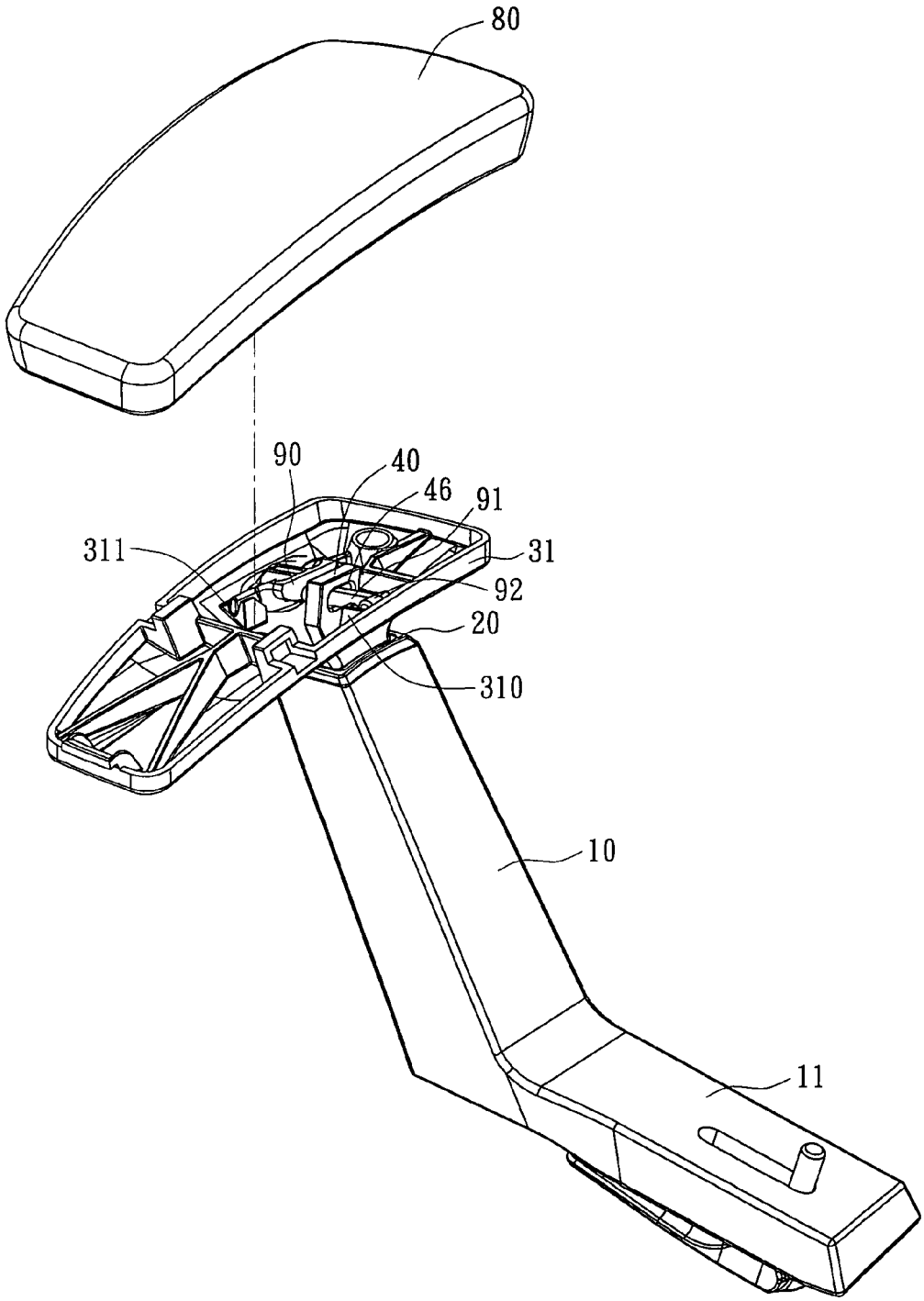
FIG. 2 is a partial explosive view of a separated armrest pad of the embodiment in FIG. 1.
Figure 5:
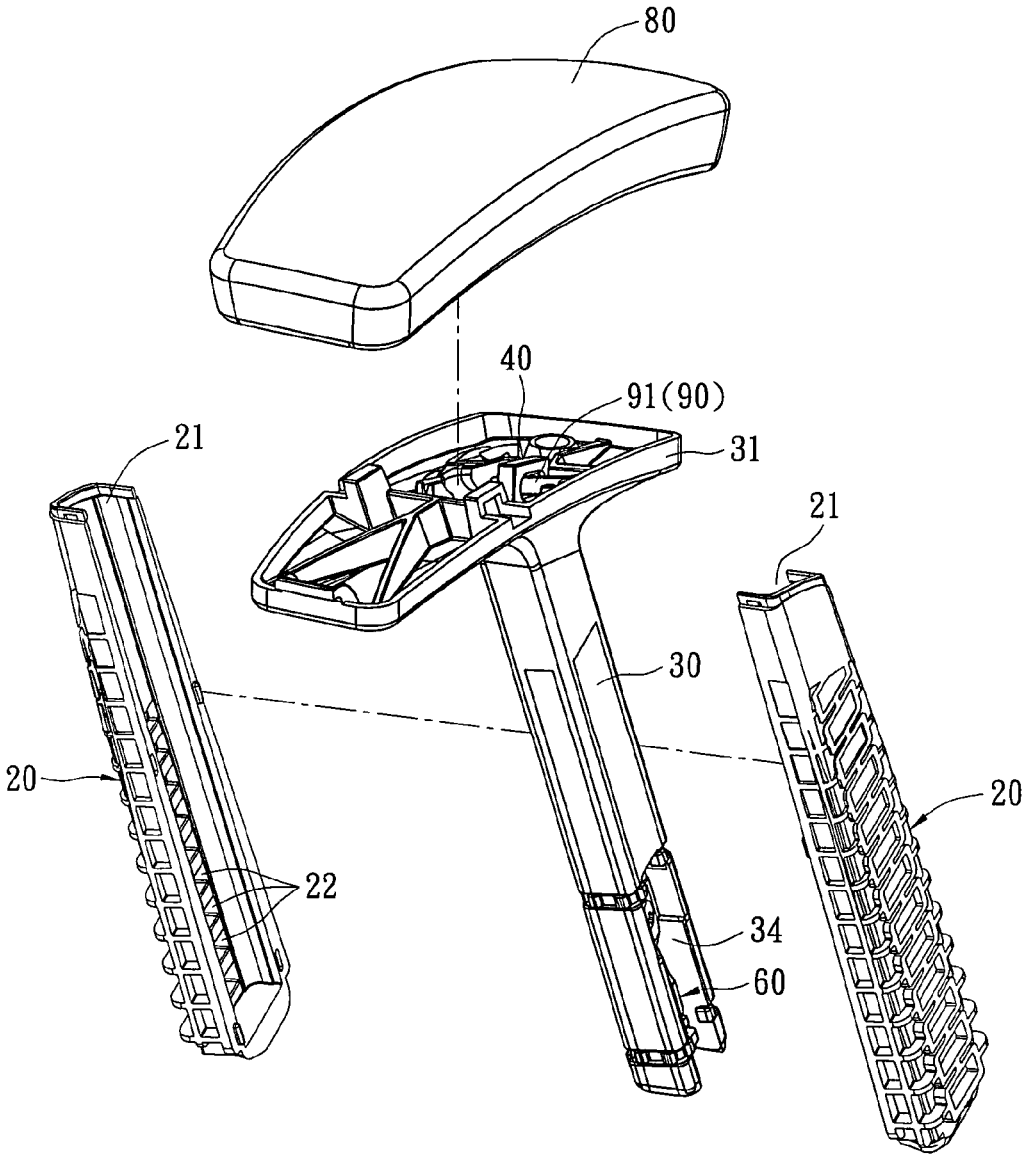
FIG. 5 is a partial explosive view of the tubular member of the embodiment in FIG. 4.
Figure 6:
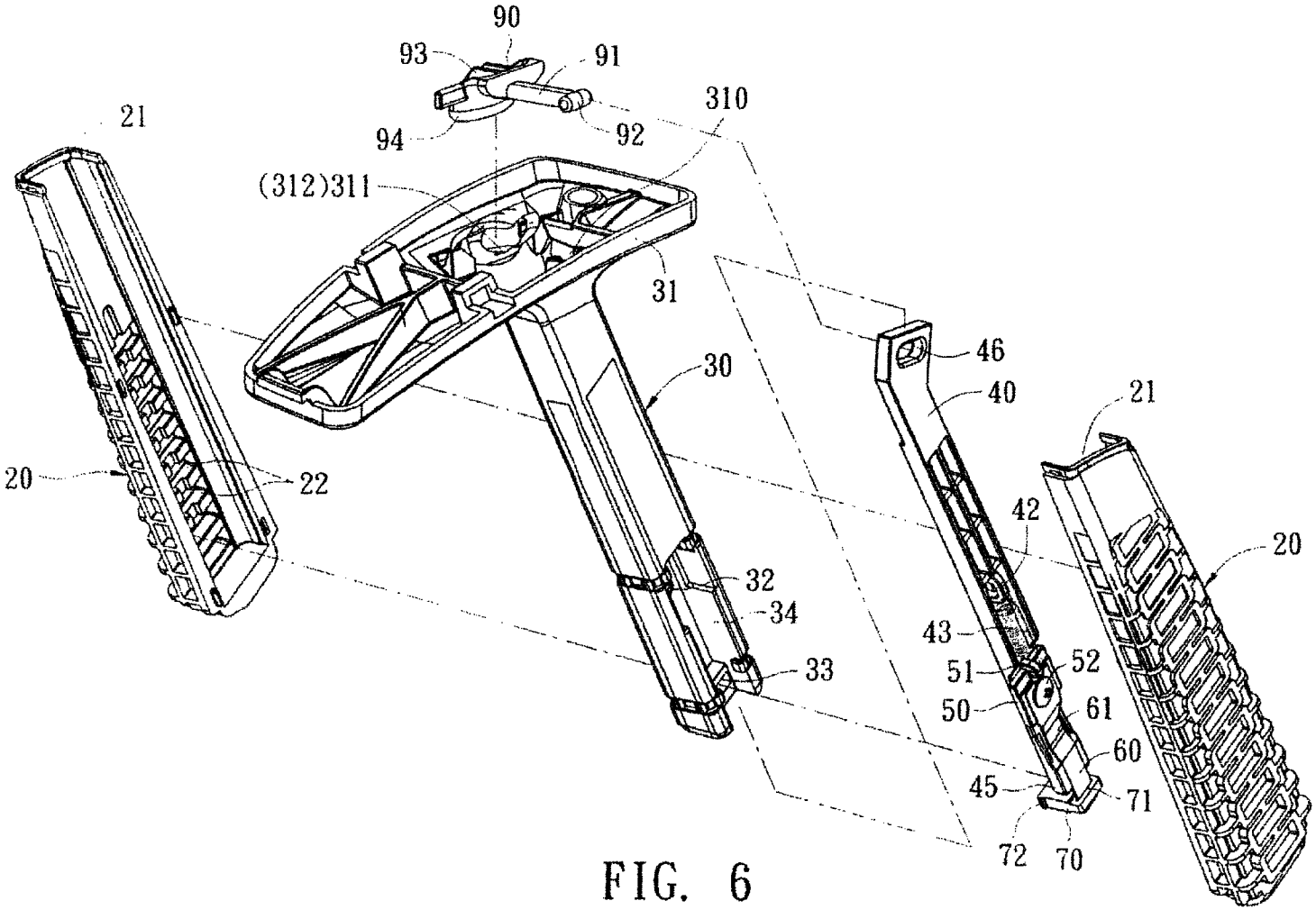
FIG. 6 is a partial explosive view of a separated long plate of the embodiment in FIG. 5.
Figure 7:
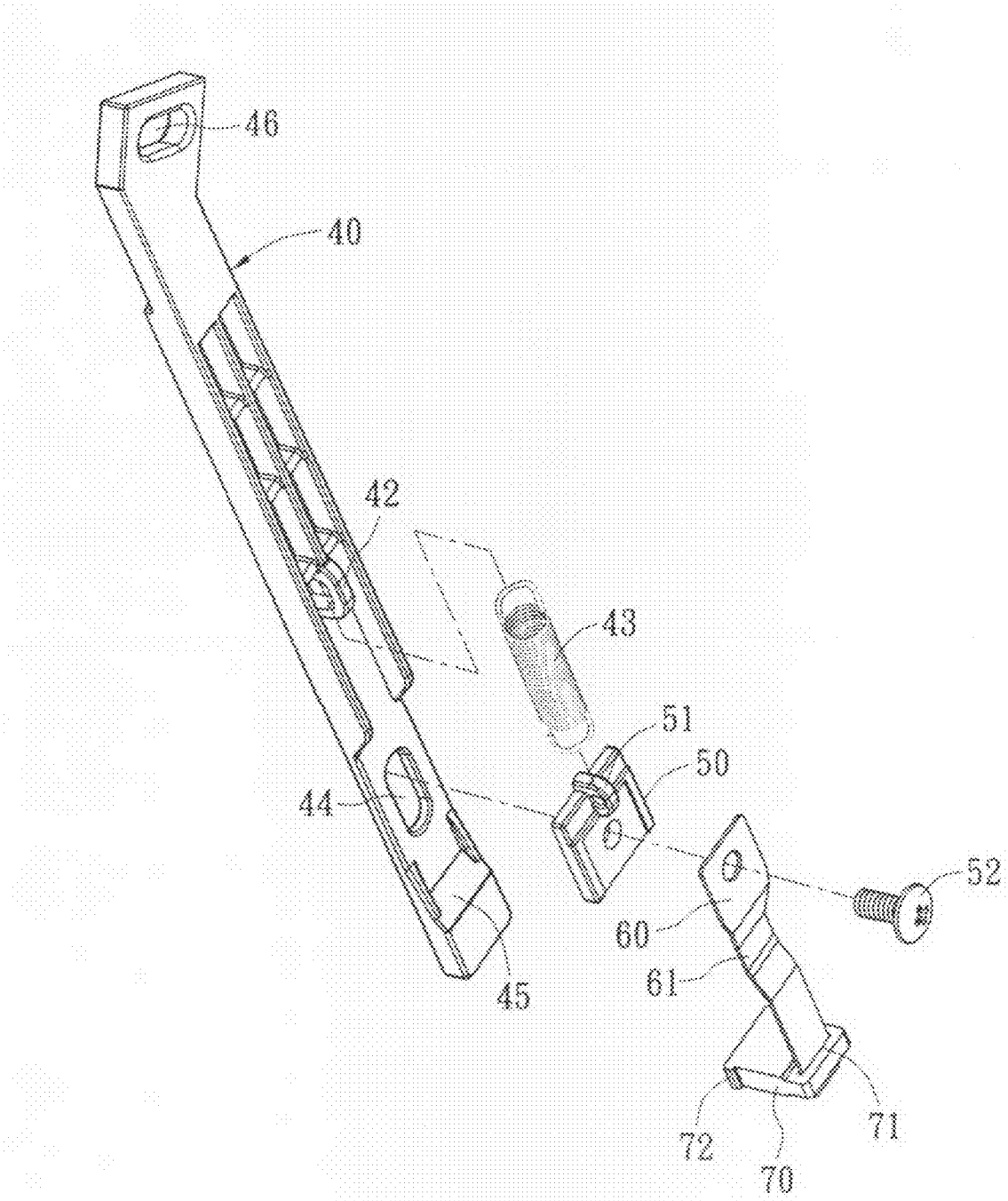
FIG. 7 is a partial explosive view of the long plate of the embodiment in FIG. 6.
Figure 11:
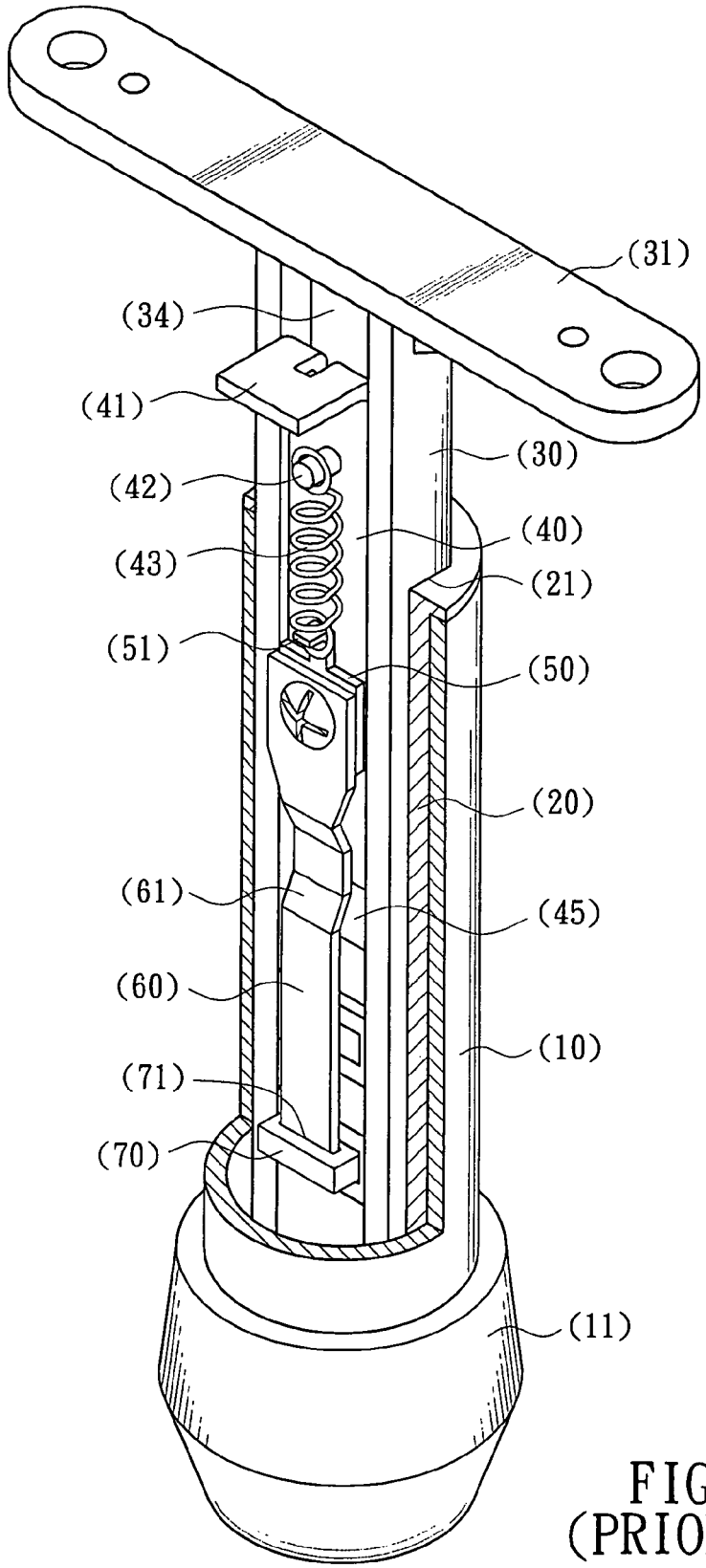
FIG. 11 (PRIOR ART)
FIG. 11 is a partial cross-sectional view of the embodiment in FIG. 10.

The sleeve 10 is fastened on a base 11 that is secured on the bottom of a chair. A tubular member 20 is fixed inside top end of the sleeve 10. The tubular member 20 can be either an integrated member, as shown in FIG. 11 or formed by two halves, as shown in FIG. 5. A sliding slot 21 is arranged on inside of the tubular member 20. A plurality of equal-distant parallel locating holes 22 is arranged on inner surface of the sliding slot 21, as shown in FIG. 5 & FIG. 6. The slider 30 is inserted in the sliding slot 21 while a concave hole 34 is located at the middle part of the slider 30. The top of the slider 30 is connected with an armrest frame. The armrest frame is designed into a lower base 31 and is assembled with an armrest pad 80 to be a complete armrest, as shown in FIG. 1 & FIG. 2. Moreover, refer to FIG. 1, FIG. 2 & FIG. 7, one side of the slider 30 (in this embodiment, this is the side facing the chair) is disposed with a long plate 40 while an insertion hole 46 is arranged on top of the long plate 40, instead of the handle on the prior art. A lug 42 on the long plate 40 is disposed under the insertion hole 46 for being hooked with a top of an extension spring 43. A vertical long hole 44 on the long plate 40 is arranged under the lug 42 and a beveled projection 45 is under the vertical long hole 44. Inserting through the vertical long hole 44 corresponding to a projecting hole 32 of the slider 30, a fastening screw 52 secures the long plate 40 with the fixing plate 50 and the guiding plate 60 and then being fixed on the projecting hole 32 of the slider 30. By top and bottom ends of the vertical long hole 44 working as stoppers, the long plate 40 slides along with the concave hole 34 of the slider 30. The relative position of the slider 30 to the fixing plate 50 as well as the guiding plate 60 is fixed. Compared with the fixed slider 30, the fixing plate 50 and the guiding plate 60, the long plate 40 is moveable. A lug 51 is disposed on the fixing plate 50 for being hooked with a lower end of the spring 43 so that after being pulled upwards and released, the long plate 40 automatically turns back to the original position by elasticity of the spring 43. Furthermore, a projection 61 beveled opposite to the beveled projection 45 is arranged on top of the guiding plate 60 while a horizontal retaining block 70 is disposed on bottom of the guiding plate 60. The guiding plate 60 is assembled with the retaining block 70 by inserting the bottom end of the guiding plate 60 into a mounting slot 71 on rear end of the retaining block 70, as shown in FIG. 6 & FIG. 7. A front end 72 of the retaining block 70 inserts horizontally through an insertion slot 33 of the slider 30 and assembles into the locating hole 22 on inner surface of the sliding slot 21.

Figure 8:
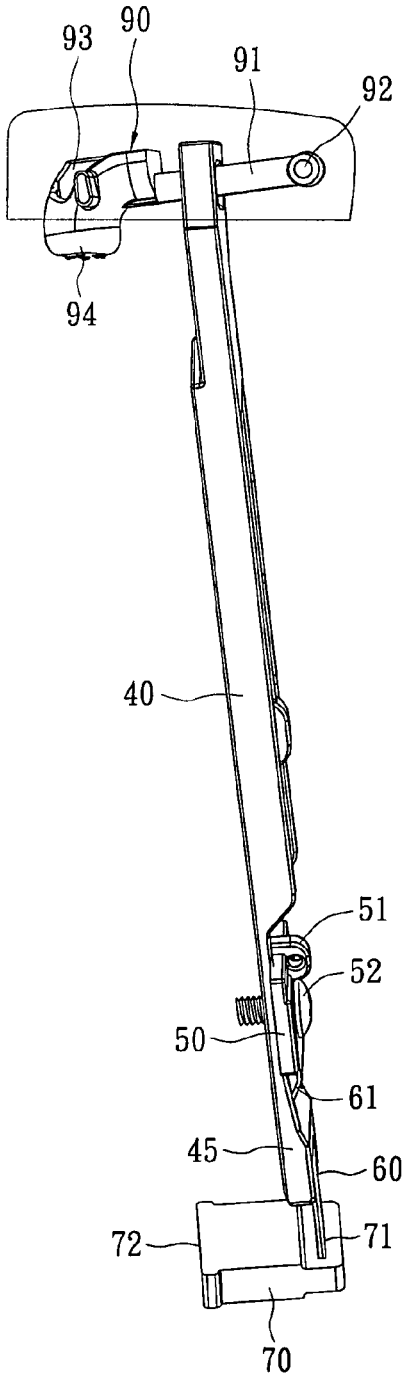
FIG. 8 is a side view before adjusting the armrest of the present invention.
Figure 9:
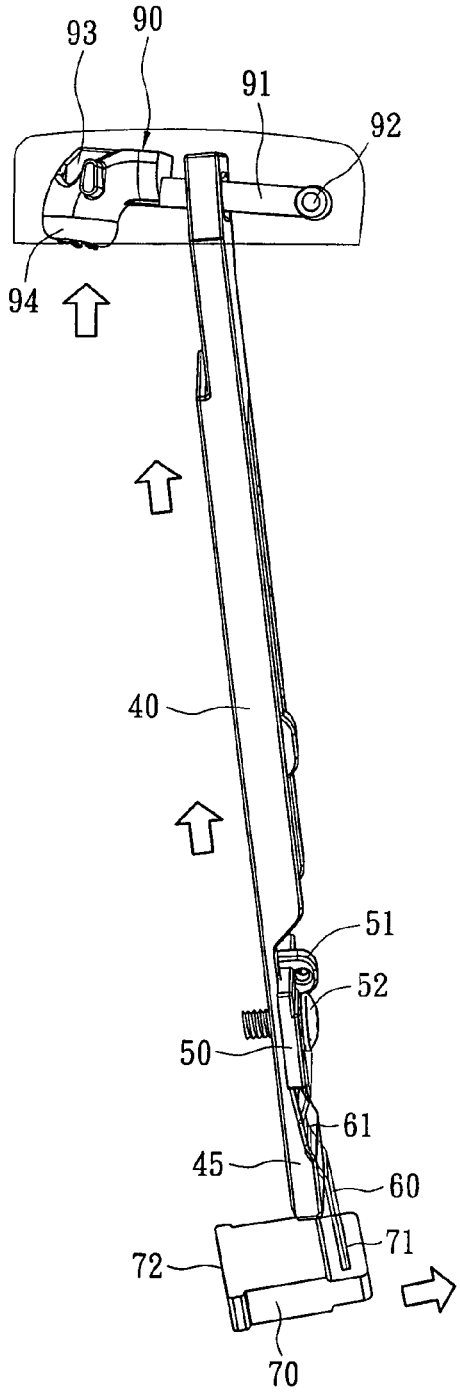
FIG. 9 is a side view while adjusting the armrest of the present invention.

In accordance with above structure, refer to FIG. 8, before adjusting the long plate 40, the beveled projection 45 on the long plate 40 doesn't move upwards so that it doesn't contact with the projection 61 of the guiding plate 60. Thus the lower end of the guiding plate 60 keeps original status-standing vertically while the retaining block 70 still locks in the locating hole 22. While adjusting (height of the armrest), refer to FIG. 9, the long plate 40 is moved upwards elastically and the extension spring 43 extends simultaneously so that the projection 45 contacts with and against the projection 61 of the guiding plate 60. And the lower end of the guiding plate 60 moves outwards, leaving original position, as shown in FIG. 8 & FIG. 9. Thus the retaining block 70 is released from the locating hole 22. Now the slider 30, moving together with the lower base 31 as well as the armrest pad 80, moves upwards and downwards freely inside the sliding slot 21 for height adjustment and there is no stopping points. After the armrest (armrest pad 80) being adjusted to another height, the long plate 40 is released and it turns back to the original position by the elasticity of the spring 43. Then the projection 45 leaves the projection 61 of the guiding plate 60 while the retaining block 70 also turns back near the original position by elasticity of the guiding plate 60 and locks in a new locating hole 22. The adjustment of the armrest is finished. The height of the armrest (or armrest pad 80) is adjusted by upward movement of the long plate 40.

Figure 3:
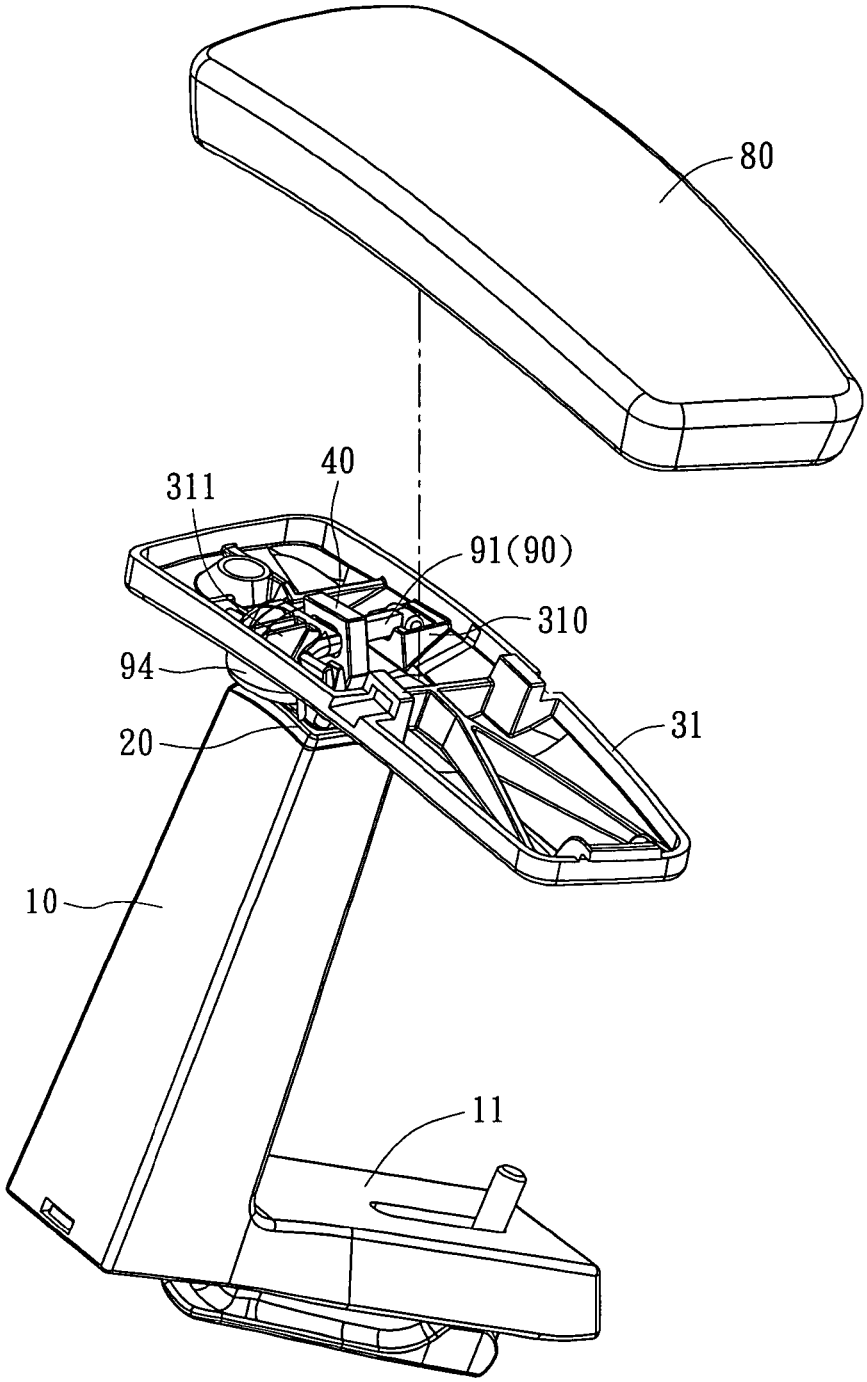
FIG. 3 is the embodiment in FIG. 2 seen from another angle of view.
Figure 4:
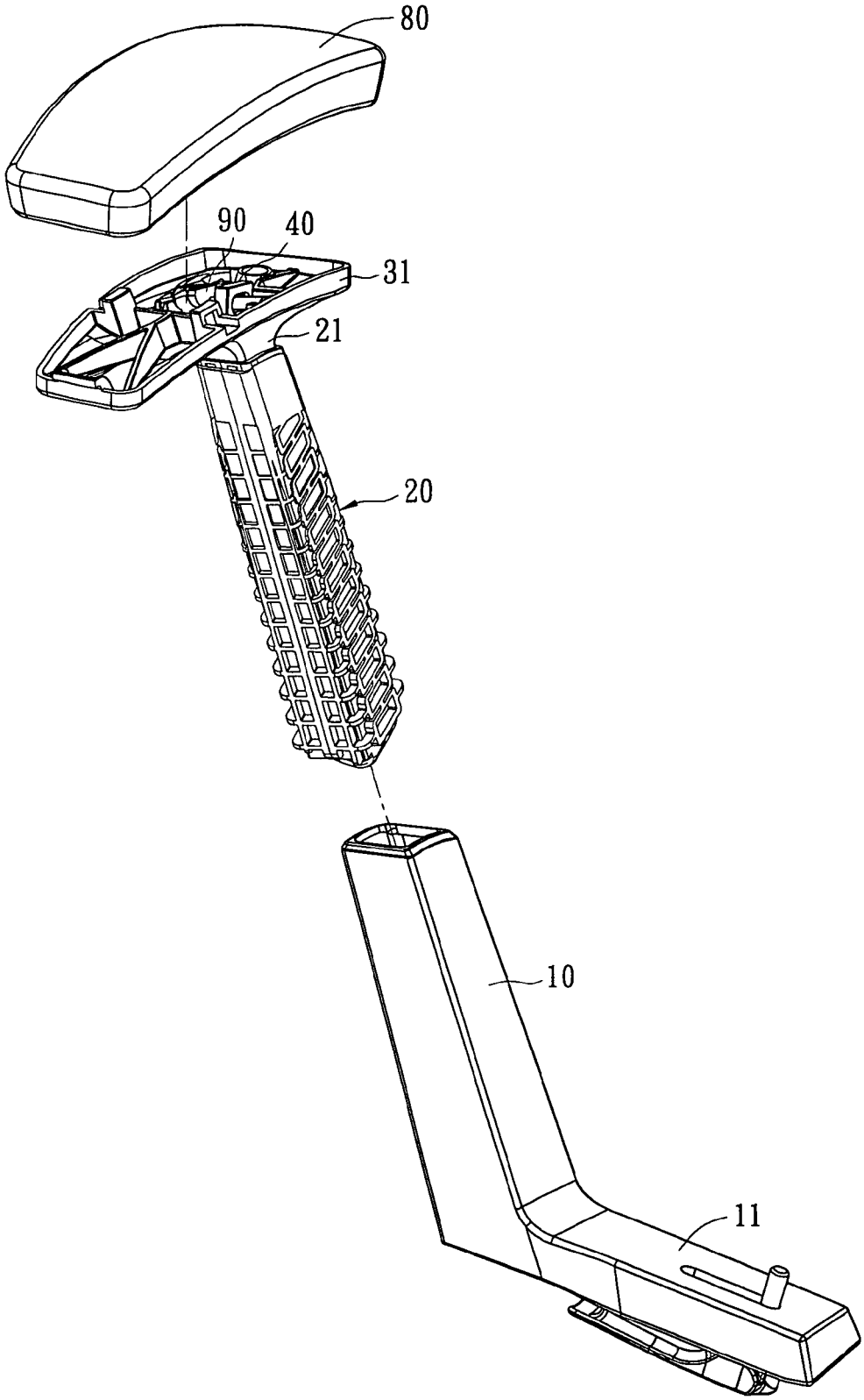
FIG. 4 is a partial explosive view of a separated tubular member of the embodiment in FIG. 2.
Figure 10:
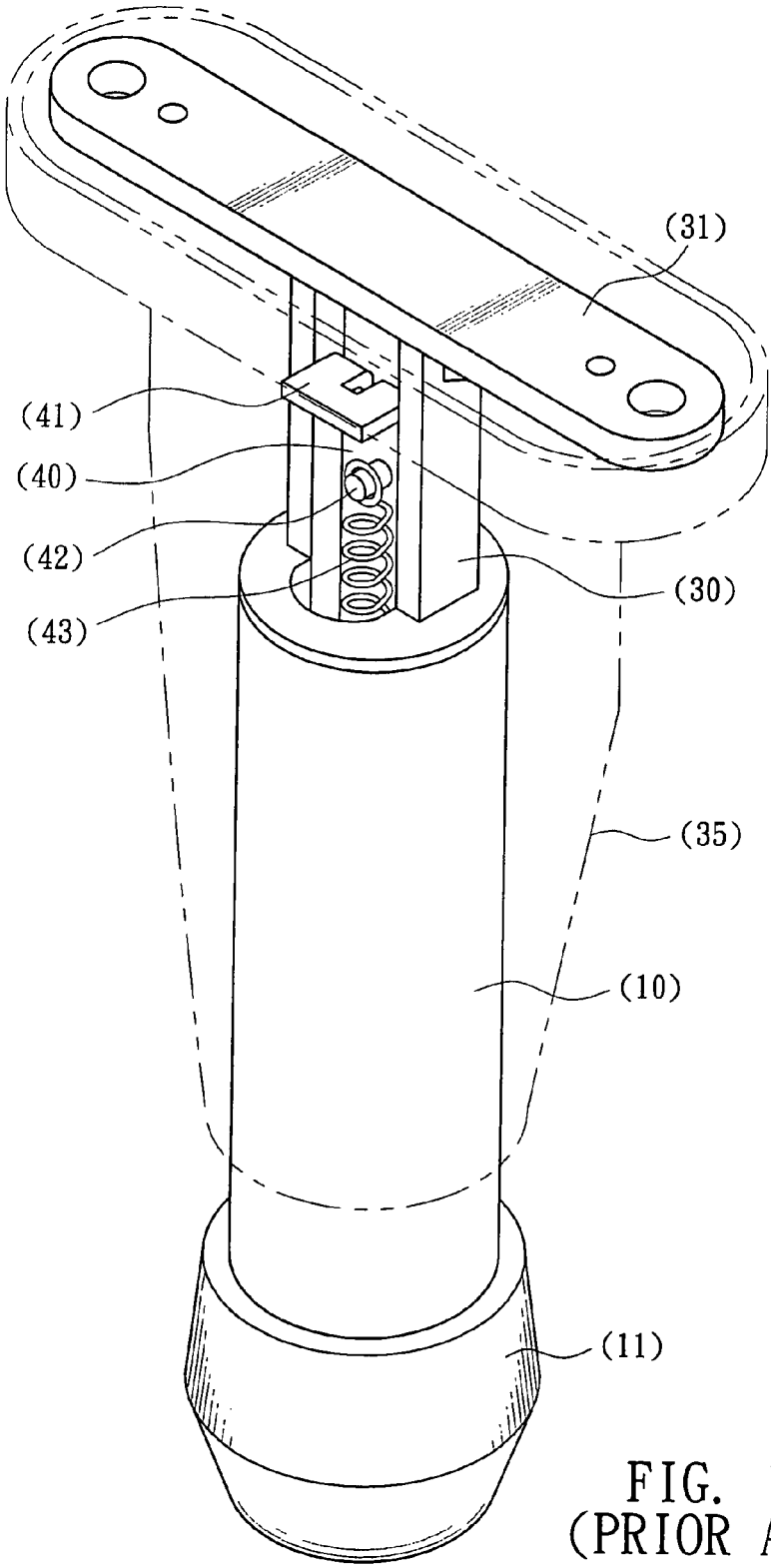
FIG. 10 (PRIOR ART)
FIG. 10 is a perspective view of a prior art (U.S. Pat. No. 6,336,680)

The present invention features on that an insertion hole 46 is disposed on upper end of the long plate 40 to replace the handle (41) projecting outside from an upper end of a long plate (40) of a prior rat, as shown in FIG. 10 & FIG. 11. Moreover, refer from FIG. 2 to FIG. 6, a lever arm 90 is arranged inside the lower base 31, between the armrest pad 80 and the lower base 31. The lever arm 90 can be one element made by plastic injection and it inserts through the insertion hole 46 of the long plate 40 so that the long plate 40 hangs on a middle part 91 of the lever arm 90, working as the load. A rear end 92 (an inner end in this embodiment) of the lever arm 90 is arranged one side 310 (the inner side) of the lower base 31, working as the fulcrum. The one side 310 (the inner side) of the lower base 31 is designed as a slot, as shown in FIG. 2, FIG. 3 & FIG. 6 so that the rear end 92 (the inner end) of the lever arm 90 is pivoted inside the slot stably. The other end (the outer end) 93 is arranged on an opposite side (the outer side) 311 of the lower base 31 correspondingly. A push member 94 extending from the outer end 93 and projecting from a corresponding opening 312 of the lower base 31 works as an effort. Therefore, the lever arm 90 becomes a Type-2 lever-that the load is at the point between the effort and the fulcrum.

In accordance with the structure mentioned above, the push member 94 is moved upwards by being pushed by the user from the outside (the bottom of the armrest pad 80) so that the lever arm 90, working like a Type-2 lever, drives the long plate 40 to move upwards synchronously, as shown in FIG. 8 & FIG. 9. Thus by operation of the long plate 40 that moves upwards, the adjustment of the armrest is achieved. Therefore, the height adjustment mechanism of the armrest is simplified and convenience of use is enhanced.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An armrest adjustment mechanism comprising:

a sleeve whose bottom is fastened on a base;

a tubular member fixed inside a top end of the sleeve and having a sliding slot as well as a plurality of equal-distant parallel locating holes arranged on an inner surface of the sliding slot;

a slider inserted in the sliding slot of the tubular member, connected with an armrest frame as well as a lower base arranged there over while a concave hole is located at middle part of the slider and a projecting hole as well as a insertion slot is disposed on the slider under the concave hole;

a long plate that slides along with the concave hole of the slider and having an insertion hole on a top end thereof, a lug under the insertion hole for being hooked with a top of a spring, a vertical long hole arranged under the lug and a beveled projection under the vertical long hole; inserting through the vertical long hole corresponding to the projecting hole of the slider, a fastening screw secures a fixing plate and a guiding plate on the projecting hole of the slider; by top and bottom ends of the vertical long hole working as stoppers, the long plate slides upwards and downwards along with the concave hole of the slider;

a fixing plate located on outer side of the long plate, secured on the projection hole of the slider and having a lug disposed on the fixing plate for being hooked with a lower end of the spring so that after being pulled upwards and released, the long plate automatically turns back to the original position by elasticity of the spring;

a guiding plate located on outer side of the fixing plate, secured on the projection hole of the slider and having a projection beveled opposite to the beveled projection of the long plate;

a retaining block arranged horizontally on a lower end of the guiding plate and inserting through the insertion slot of the slider horizontally so that a front end of the retaining block lock into the locating hole on the inner surface of the sliding slot of the tubular member;

a lower base arranged over the slider;

an armrest pad assembled over the lower base;

a lever arm arranged between the armrest pad and the lower base, inserting through the insertion hole on the top end of the long plate so that the long plate hangs on a middle part of the lever arm, working as a load; one end of the lever arm is arranged on one side of the lower base, working as a fulcrum while the other end of the lever arm is arranged on an opposite side of the lower base correspondingly; a push member projecting from a corresponding opening of the lower base is arranged on the other end of the lever arm, working as an effort so that the lever arm becomes a class two lever in which the load is at a point between the effort and the fulcrum;

by pushing the push member to move upwards, the lever arm is driven to make the long plate move upwards synchronously and then the beveled projection of the long plate contact with and against the projection of the guiding plate while the lower end of the guiding plate moves outwards, leaving original position, and the retaining block is released from the locating hole; then the slider moves upwards and downwards freely inside the sliding slot synchronously for height adjustment of the armrest pad; when the push member is released, the long plate turns back to the original position by the elasticity of the spring and the beveled projection leaves the projection of the guiding plate while the retaining block also turns back near the original-position by elasticity of the guiding plate and locks in a new locating hole so that the height adjustment of the armrest is finished.

2. The device as claimed in claim 1, wherein the tubular member is formed by two halves.

3. The device as claimed in claim 1, wherein the lever arm is an integrated member formed by plastic injection.

4. The device as claimed in claim 1, wherein one side of the lower base is disposed with a slot so that the rear end of the lever arm is pivoted inside the slot.

* * * * *